US008061817B2

(12) United States Patent
Nakajima et al.

(10) Patent No.: US 8,061,817 B2
(45) Date of Patent: Nov. 22, 2011

(54) DROPLET JET UNIT AND DROPLET JET DEVICE

(75) Inventors: Yoshinori Nakajima, Nara (JP); Toshiyuki Tanaka, Hirakata (JP); Hirotugu Matoba, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 777 days.

(21) Appl. No.: 12/086,322

(22) PCT Filed: Dec. 8, 2006

(86) PCT No.: PCT/JP2006/324528

§ 371 (c)(1),
(2), (4) Date: Jun. 9, 2008

(87) PCT Pub. No.: WO2007/066753

PCT Pub. Date: Jun. 14, 2007

(65) Prior Publication Data

US 2009/0303288 A1 Dec. 10, 2009

(30) Foreign Application Priority Data

Dec. 9, 2005 (JP) ..... 2005-355560
Jan. 31, 2006 (JP) ..... 2006-022640

(51) Int. Cl.
*B41J 2/05* (2006.01)

(52) U.S. Cl. ..... 347/65

(58) Field of Classification Search ..... 347/65, 347/66, 85, 86, 87, 89, 50, 55, 56
See application file for complete search history.

(56) References Cited

U.S. PATENT DOCUMENTS

| | | | | |
|---|---|---|---|---|
| 5,017,941 | A | 5/1991 | Drake | |
| 5,801,736 | A * | 9/1998 | Ikkatai et al. | 347/86 |
| 5,956,062 | A * | 9/1999 | Omata et al. | 347/89 |
| 6,328,426 | B1 * | 12/2001 | Chahn et al. | 347/55 |
| 6,634,741 | B2 * | 10/2003 | Kataoka et al. | 347/92 |
| 7,370,934 | B2 * | 5/2008 | Ito | 347/20 |
| 7,604,327 | B2 * | 10/2009 | Sugahara | 347/56 |
| 2004/0085416 | A1 | 5/2004 | Kent | |
| 2005/0206686 | A1 | 9/2005 | Hirano | |

FOREIGN PATENT DOCUMENTS

| | | | |
|---|---|---|---|
| JP | 5-169662 | A | 7/1993 |
| JP | 10-86405 | A | 4/1998 |
| JP | 10-100446 | A | 4/1998 |
| JP | 2000-190500 | A | 7/2000 |
| JP | 2001-322285 | A | 11/2001 |
| JP | 2001-324069 | A | 11/2001 |
| JP | 2003-159812 | A | 6/2003 |
| JP | 2004-262203 | A | 9/2004 |

* cited by examiner

*Primary Examiner* — Anh T. N. Vo
(74) *Attorney, Agent, or Firm* — Edwards Wildman Palmer LLP; David G. Conlin, Esq.; Edmund Koundakjian

(57) ABSTRACT

An ink-jet head (1) jets supplied liquid through plural nozzles (14). The ink-jet head (1) includes a liquid introduction port (23A), a liquid discharge port (23B), a common liquid chamber, and plural individual liquid chambers. The liquid introduction port (23A) introduces the liquid supplied from the outside. The liquid discharge port (23B) discharges the liquid to the outside. The common liquid chamber is disposed so as to communicate with the liquid introduction port (23A) and with the liquid discharge port (23B). The plural individual liquid chambers communicate with the common liquid chamber and with respective of the plural nozzle openings (14).

8 Claims, 9 Drawing Sheets

DROPLET JET UNIT AND DROPLET JET DEVICE

TECHNICAL FIELD

The present invention relates to a droplet jet unit for jetting droplets through plural nozzles, as well as a droplet jet device including the same.

BACKGROUND ART

A droplet jet device includes a droplet jet unit configured to jet droplets through plural nozzles. The droplet jet unit has a common liquid chamber and individual liquid chambers. The droplet jet unit guides liquid supplied to the common liquid chamber to each of the individual liquid chambers and then jets the liquid from the individual liquid chambers to the outside through the nozzles. Representative droplet jetting systems include: a system configured to mechanically deform each of the individual liquid chambers in order to produce a pressure therein, thereby jetting droplets; and a system configured to vaporize the liquid contained in each of the individual liquid chambers by means of a heating element disposed therein in order to produce a pressure therein, thereby jetting droplets.

In incorporating the droplet jet unit into the droplet jet device, conventionally, use has been often made of a flow path forming member and a base member. The flow path forming member serves to form a flow path through which liquid to be introduced into the droplet jet unit flows. The base member serves to carry thereon some parts including the droplet jet unit and the flow path forming member. Conventionally, the reliability of such a droplet jet device has been improved by making contrivances to the configurations of the droplet jet unit, flow path forming member and base member and to the manner of assembling these components.

In recent years, by an increase in the nozzle density or nozzle count of the droplet jet unit, the droplet jet device has come to generate heat easily. As a result, a problem has arisen that crack occurs during use due to differences in linear expansion coefficient among the materials forming respective of the droplet jet unit, flow path forming member and base member.

Conventional techniques for solving such a problem include a technique wherein an elastic member is disposed between the droplet jet unit and the base member (see patent document 1 for example), and a technique wherein a ceramic material is used for the base member (see patent document 2 for example). These techniques have been said to be capable of preventing the occurrence of crack or the like due to the difference in linear expansion coefficient between the droplet jet unit and the base member.

The droplet jet device further includes a driving circuit for driving the droplet jet unit. The driving circuit is connected to the droplet jet unit via a connecting section. Such driving circuit and connecting section are susceptible to liquid and, hence, it is sometimes the case that the driving circuit and connecting section are damaged when splashed with liquid. For this reason, some conventional droplet jet devices are each provided with a protection cover for protecting the driving circuit and connecting section (see patent document 3 for example).

Patent document 1: Japanese Patent Laid-Open Publication No. 2001-322285A

Patent document 2: Japanese Patent Laid-Open Publication No. 2000-190500A

Patent document 3: Japanese Patent Laid-Open Publication No. 2004-262203A

DISCLOSURE OF INVENTION

Problem to be Solved by Invention

Problems caused by the increase in nozzle density or nozzle count include not only the occurrence of crack or the like due to the differences in linear expansion coefficient among members but also other problems. For example, the increase in nozzle density or nozzle count has sometimes caused air to be easily accumulated in the common liquid chamber. When air is accumulated in the common liquid chamber, such an inconvenience as a failure to jet droplets is likely to occur. It is therefore necessary for such accumulated air in the common liquid chamber to be removed efficiently. When consideration is given particularly to the request existing in recent years for rendering the droplet jet device compact, it is critical to remove air accumulated in the common liquid chamber by an arrangement as simple as possible.

With respect to the conventional droplet jet device which is provided with a separate protection cover, the parts count thereof has increased by the provision of such a protection cover. The protection cover needs to have a size increased to some extent so as to cover the driving circuit and connecting section adequately. Therefore, the mounting of the protection cover has sometimes prevented the droplet jet device from being rendered compact.

An object of the present invention is to provide a droplet jet unit which is capable of efficiently removing air accumulated in the common liquid chamber while providing for a compact device, as well as a droplet jet device including such a droplet jet unit.

Another object of the present invention is to provide a droplet jet device which is capable of properly protecting the driving circuit and connecting section while realizing a compact device.

Means for Solving Problem (1) A droplet jet unit according to a first invention is a droplet jet unit for jetting supplied liquid through plural nozzles, comprising a main body, a common liquid chamber, plural individual liquid chambers, a liquid introduction port, and a liquid discharge port.

The common liquid chamber is located inside the main body. The plural individual liquid chambers are located inside the main body and communicate with the common liquid chamber and with respective of the plural nozzles. The liquid introduction port is continuous with the common liquid chamber and exposed at a first lateral side of the main body. The liquid discharge port is continuous with the common liquid chamber and exposed at a second lateral side of the main body which is opposite away from the first lateral side.

The liquid introduction port is an opening for introducing the liquid into the common liquid chamber from the outside of the main body. The liquid introduced into the common liquid chamber flows into each of the individual liquid chambers and is then jetted from the individual liquid chambers to the outside through the nozzles. Further, the common liquid chamber is also continuous with the liquid discharge port. The liquid discharge port is an opening located on the side of the common liquid chamber that is opposite away from the liquid introduction port, for discharging the liquid from the common liquid chamber. The liquid introduced into the common liquid chamber through the liquid introduction port is discharged from the common liquid chamber through the liquid discharge port located on the opposite side.

By providing the common liquid chamber with the liquid introduction port and the liquid discharge port, a flow path for removing air accumulated in the common liquid chamber can be formed easily when the droplet jet unit is applied to the droplet jet device.

(2) A droplet jet device according to a second invention is a droplet jet device for jetting liquid supplied from a liquid storage section, comprising a droplet jet unit, a driving circuit, a connecting section, a base member, and a flow path forming unit. The droplet jet unit jets the liquid through plural nozzles. The driving circuit drives the droplet jet unit. The connecting section interconnects the droplet jet unit and the driving circuit. The base member carries the droplet jet unit and the driving circuit thereon. The flow path forming unit is connected to the liquid storage section and to the droplet jet unit and defines therein a liquid flow path to be connected to the liquid storage section and to the droplet jet unit. Further, the flow path forming unit is disposed so as to cover the connecting section and the driving circuit.

Since the flow path forming unit is an indispensable member for any droplet jet device, every droplet jet device includes such a flow path forming unit. The connecting section and driving circuit can be protected from liquid by the flow path forming unit covering the connecting section and driving circuit, without the need to provide a separate protection cover. The provision of the flow path forming unit which serves also as a protection cover makes it possible to limit an increase in parts count, thereby to render the droplet jet device compact. As a result, in cases where a plurality of such droplet jet devices are arranged, it is possible to arrange the droplet jet devices with a small pitch.

Effects of the Invention (1) According to the first invention, it is possible to remove air accumulated in the common liquid chamber efficiently by a simple arrangement.

(2) According to the second invention, it is possible to protect the base member and the parts mounted thereon by a simple arrangement.

DESCRIPTION OF REFERENCE CHARACTERS

Figure 1A:
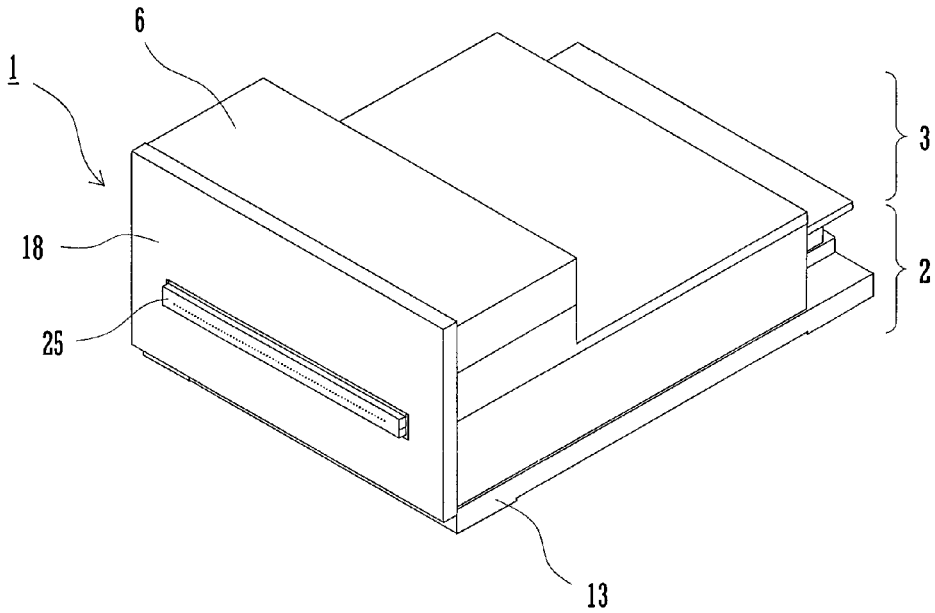
FIG. 1 is a perspective view showing an ink-jet head according to an embodiment of the present invention.

1 ink-jet head
2 base unit
3 filter unit
4 driver board
11 head chip
12 chip mount
13 head base
14A,14B manifold
23A liquid introduction port
23B liquid discharge port

BEST MODE FOR CARRYING OUT THE INVENTION

Figure 1B:
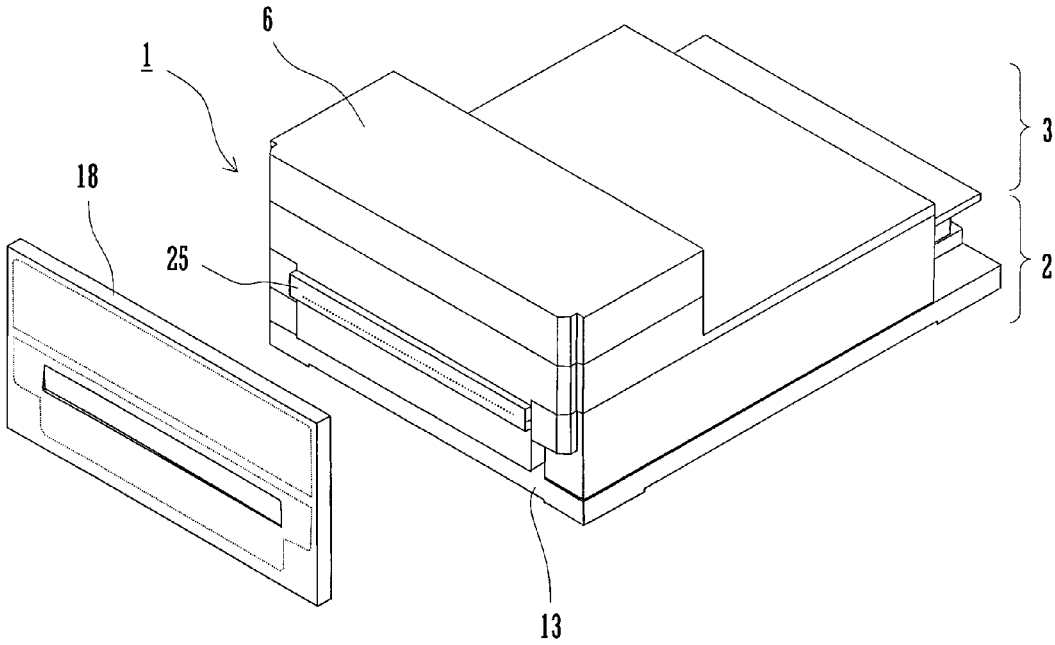

FIGS. 1(A) and 1(B) show an ink-jet head 1 as an embodiment of a droplet jet device according to the present invention. The ink-jet head 1 includes a cover member 18, a base unit 2, and a filter unit 3. The cover member 18 is disposed so as to cover surfaces of the base unit 2 and filter unit 3 on an ink jetting side. FIG. 1(A) shows a state in which the cover member 18 is fitted on the base unit 2 and filter unit 3, while FIG. 1(B) shows a state in which the cover member 18 is detached from the base unit 2 and filter unit 3.

Figure 2:
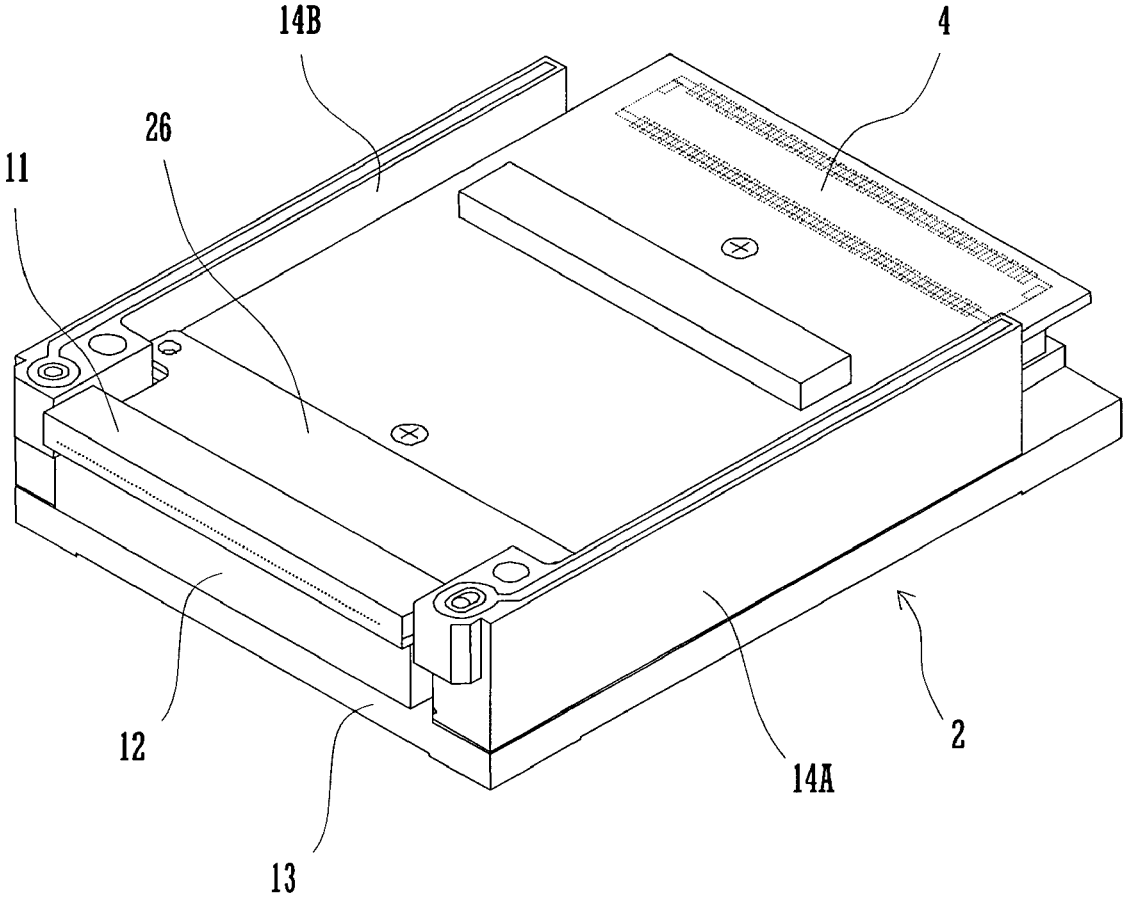
FIG. 2 is a perspective view showing a base unit.

The configuration of the base unit 2 will be described with reference to FIGS. 2 to 5. As shown in FIG. 2, the base unit 2 is basically line-symmetric. The base unit 2 includes a head base 13, chip mount 12, head chip 11, flexible board 26, driver board 4, and manifolds 14A and 14B.

Figure 3:
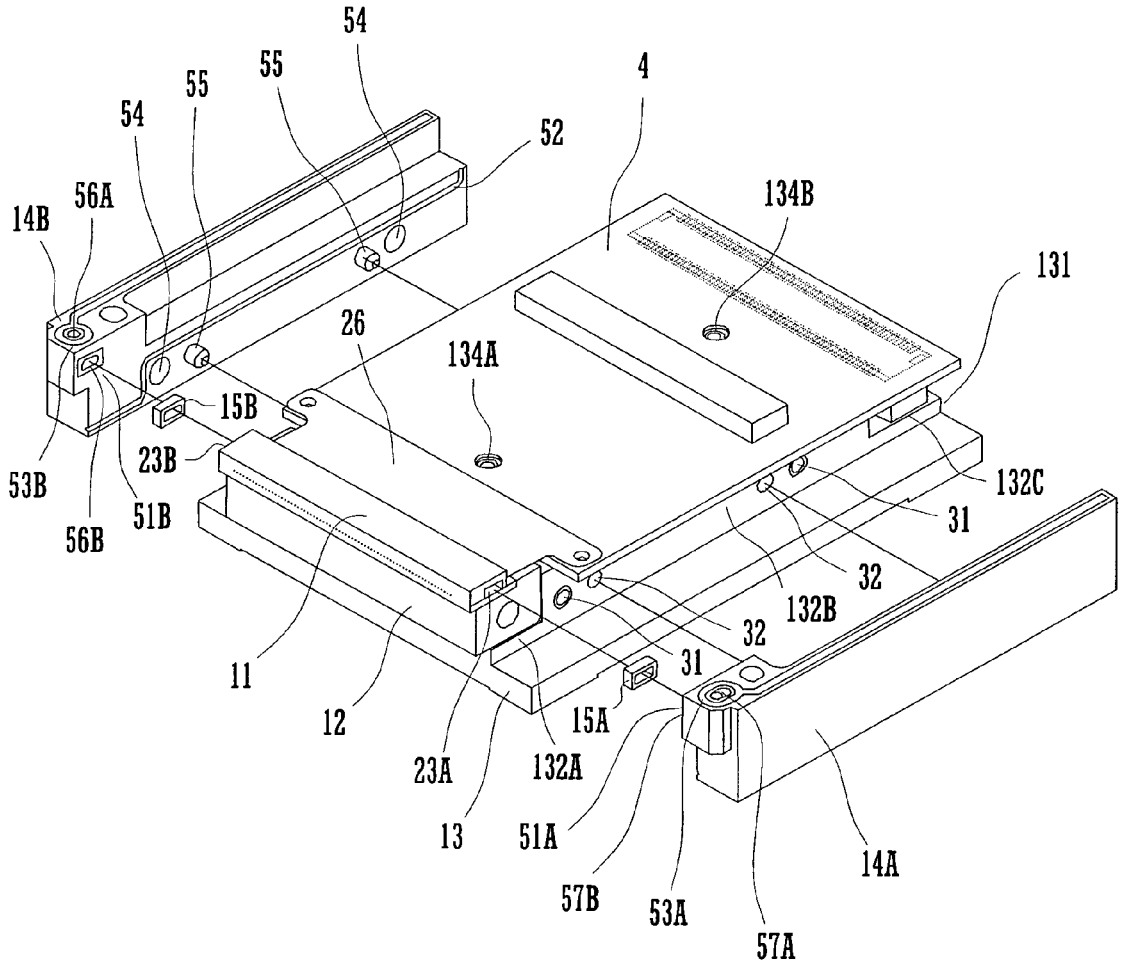
FIG. 3 is an exploded view schematically showing the configuration of the base unit.

The head base 13 forms a base member defined by the present invention. The head base 13 is formed from a metallic material. In the present embodiment, SUS (having a linear expansion coefficient of about $11\times10^{-6}$ m/K) is used as the material of the head base 13. As shown in FIG. 3, the head base 13 is formed with a protruding mount portion 131 on a surface thereof and has an inverted T-shaped section. The mount portion 131 is formed in a transversely (hereinafter will be referred to as "widthwise) central portion of the head base 13 and extends longitudinally (hereinafter will be referred to as "lengthwise") of the head base 13. In the mount portion 131, first to third mounts 132A, 132B and 132C are arranged in the lengthwise direction.

Figure 4:
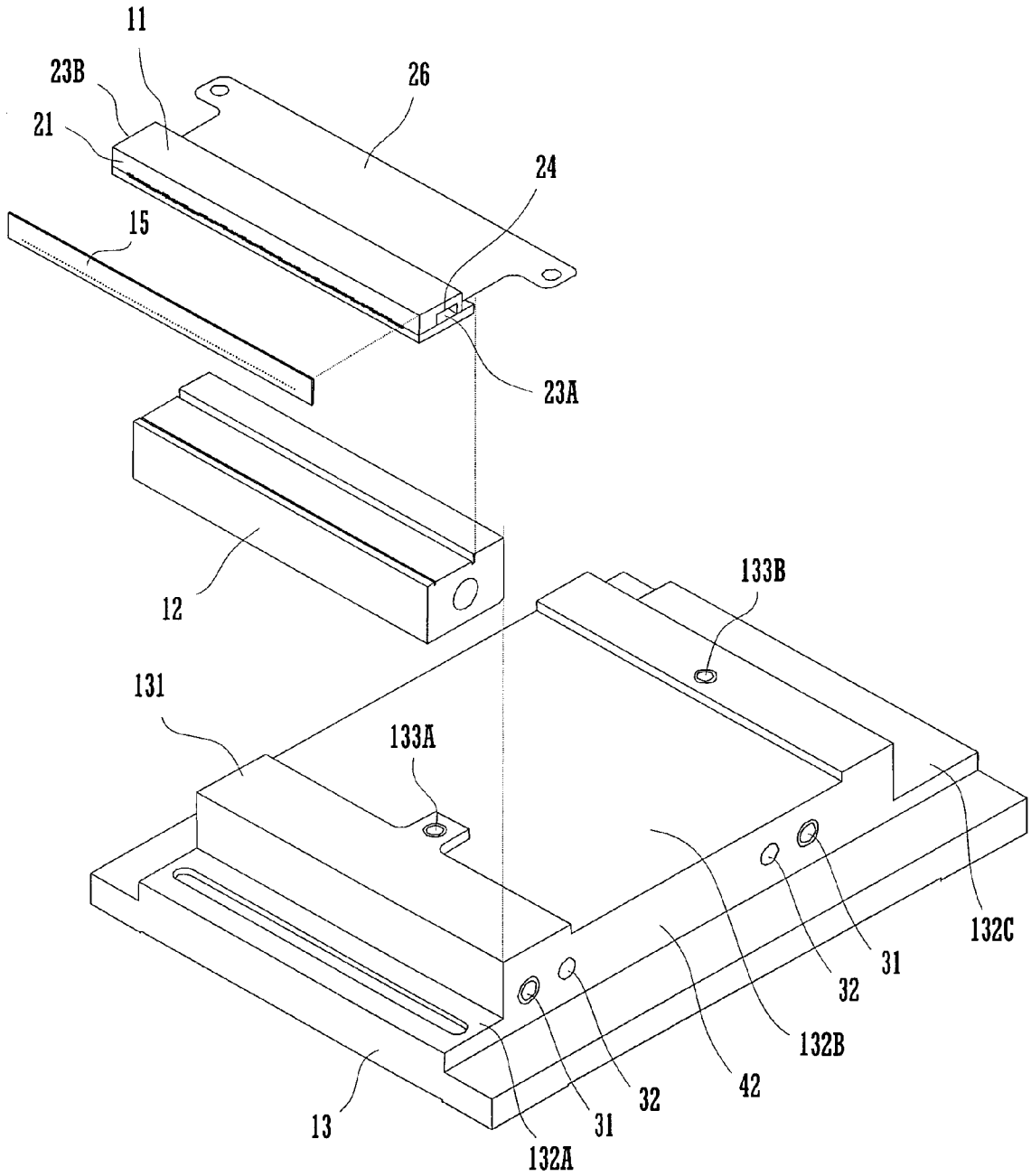
FIG. 4 is a view showing the configurations of a head base, chip mount and head chip.

As shown in FIG. 4, the chip mount 12 is bonded to the first mount 132A by means of adhesive. The chip mount 12 forms an intervening member defined by the present invention. The chip mount 12 is formed from alumina (having a linear expansion coefficient of about $4\times10^{-6}$ m/K). Other examples of materials for the chip mount 12 include hard ceramics such as aluminum nitride. Such a hard ceramic is used because the hard ceramic has a linear expansion coefficient substantially equal to that of silicon or piezoelectric material forming the base material of the head chip 11 and hence is not likely to cause thermal stress to be produced between the head chip 11 and the chip mount 12 when the temperature changes. Also, the hard ceramic, which has a high Young's modulus and is rich in toughness, fails to be destroyed by the thermal stress produced between the chip mount 12 and the head base 13. The head chip 11 is bonded to the chip mount 12 by means of the adhesive. In the present embodiment, the adhesive used is an epoxy adhesive. However, there is no limitation to the type of adhesive used in the present embodiment.

In the present embodiment, any one of the first, second and third mounts 132A, 132B and 132C has a width of 12 mm, the chip mount 12 has a width of 11.5 mm, and the head chip 11 has a width of 12 mm. In fixing the chip mount 12 to the first mount 132A, the chip mount 12 is positioned in such a manner that widthwise opposite ends of the chip mount 12 are each recessed by about 0.25 mm from a respective one of widthwise opposite ends of the first mount 132A. At that time, the widthwise opposite end faces of the head chip 11 are positioned substantially coplanar with respective of widthwise opposite end faces of each of the first to third mounts 132A, 132B and 132C.

Each of the widthwise opposite end faces of the second mount 132B has plural internal thread portions 31 and plural positioning holes 32. The driver board 4 is mounted on the second mount 132B. The surface of the second mount 132B on which the driver board 4 is mounted is formed with tapped holes 133A and 133B. The driver board 4 is fixed to the second mount 132B by thrusting screws 134A and 134B into the respective tapped holes 133A and 133B through holes defined by the driver board 4. The driver board 4 is connected to the head chip 11 via the flexible board 26. The flexible board 26 used in the present embodiment forms a connecting section defined by the present invention.

Figure 5:
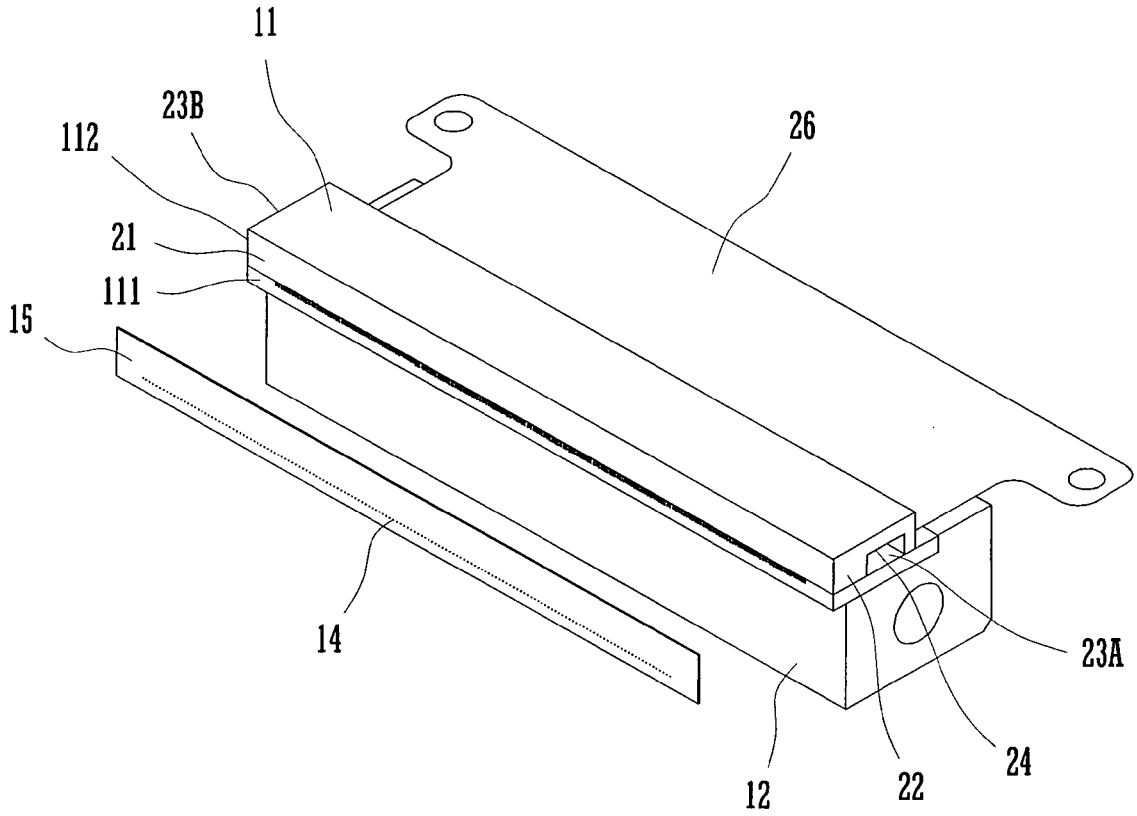
FIG. 5 is a perspective view showing the configuration of the head chip.

FIG. 5 is a view showing the configurations of the chip mount 12, head chip 11 and flexible board 26.

The head chip 11 forms a droplet jet unit defined by the present invention. The head chip 11 includes two piezoelectric substrates 111 and 112 superposed on each other, each of which comprises lead zirconium titanate (PZT) having a linear expansion coefficient ranging from $2\times10^{-6}$ to $7\times10^{-6}$ m/K.

The piezoelectric substrate 111 is polarized and formed with a plurality of parallel grooves at a surface to face the piezoelectric substrate 112. A sidewall surface of each of the plural grooves is formed with a driving electrode. On the other hand, the piezoelectric substrate 112 is not polarized and is bonded to the groove forming surface side of the piezoelectric substrate 111. The piezoelectric substrate 112 is formed with a groove 24 extending over the entire width thereof and has a substantially inverted U-shaped section. When the piezoelectric substrates 111 and 112 are bonded together, the plural grooves of the piezoelectric substrate 111 each form a respective one of individual liquid chambers, while the groove 24 of the piezoelectric substrate 112 forms a common liquid chamber. The individual liquid chambers, common liquid chamber and the exterior of the head chip 11 are coated with a protection film by parylene coating.

The groove 24 appears as a liquid introduction port 23A at a widthwise first lateral side of the head chip 11. The groove 24 appears also as a liquid discharge port 23B at a widthwise second lateral side of the head chip 11 which is opposite away from the first lateral side. As a result, the liquid introduction port 23A and the liquid discharge port 23B communicate with each other through the common liquid chamber formed inside the head chip 11.

When the piezoelectric substrates 111 and 112 are superposed on each other, the plural grooves of the piezoelectric substrate 111 are exposed at an ink jetting side. A nozzle plate 15 comprising a polyimide film is bonded to the ink jetting side. The nozzle plate 15 has plural nozzle openings 14 arranged with the same pitch as the plural grooves of the piezoelectric substrate 111.

The head chip 11 has connecting electrodes on the side opposite away from the ink jetting side, each of which is led out of a respective one of the plural individual liquid chambers. The connecting electrodes are electrically connected to the flexible board 26 through ACF (anisotropic conductive film).

Referring again to FIG. 3, description will be made of the manifolds 14A and 14B. The manifolds 14A and 14B form first and second flow path forming members, respectively, defined by the present invention. For convenience of description, a surface of the manifold 14A that faces the base unit 2 will be referred to as "internal surface of the manifold 14A" and, likewise, a surface of the manifold 14B that faces the base unit 2 will be referred to as "internal surface of the manifold 14B".

The manifolds 14A and 14B are formed from PEEK (polyether ether ketone). The manifolds 14A and 14B are symmetric with respect to each other. The manifolds 14A and 14B each define therein a liquid flow path to become continuous with the common liquid chamber. The liquid flow path in the manifold 14A extends between a first opening 57A and a second opening 57B. Likewise, the liquid flow path in the manifold 14B extends between a first opening 56A and a second opening 56B. The second opening 57B of the manifold 14A is positioned coincidentally with the liquid introduction port 23A. A recess 51A is formed around the second opening 57B. Similarly, the second opening 56B of the manifold 14B is positioned coincidentally with the liquid discharge port 23B. A recess 51B is formed around the second opening 56B. In the present embodiment, the recesses 51A and 51B are each 0.8 mm deep.

The internal surfaces of the respective manifolds 14A and 14B are each formed with plural throughholes 54 and plural positioning pins 55. Further, the internal surfaces of the respective manifolds 14A and 14B are each formed with a V-groove 52. In mounting the manifolds 14A and 14B on the base unit 2, each V-groove 52 is applied with an epoxy adhesive.

In mounting the manifolds 14A and 14B on the base unit 2, an elastic seal member 15A is disposed between the second opening 57B and the liquid introduction port 23A and, similarly, an elastic seal member 15B disposed between the second opening 56B and the liquid discharge port 23B. In the present embodiment, the elastic seal members 15A and 15B each comprise a frame-like packing of perfluoro rubber. The elastic seal members 15A and 15B are each designed to have a hollow region having a size (2.4×1.1 mm) equal to the opening size of each of the liquid introduction port 23A and the liquid discharge port 23B. The elastic seal members 15A and 15B are fitted into the recesses 51A and 51B, respectively. The elastic seal members 15A and 15B each have a thickness of 1.1 mm, which is larger by about 0.3 mm than the depth of the recesses 51A and 51B. For this reason, the elastic seal members 15A and 15B are deformed elastically by compression when the manifolds 14A and 14B are mounted on the base unit 2. The elastic seal members 15A and 15B provide communication between the liquid flow path defined in the manifold 14A and the common liquid chamber and between the liquid flow path defined in the manifold 14B and the common liquid chamber. The elastic seal members 15A and 15B used here each produce a repulsion force of about 9.8 N when compressed by 0.3 mm.

In mounting the manifolds 14A and 14B on the base unit 2, the plural positioning pins 55 are each fitted into a respective one of the plural positioning holes 32. Further, by fitting screws into respective of the plural internal thread portions 31 through respective of the plural throughholes 54, the manifolds 14A and 14B are fixed to the base unit 2. By mounting the manifolds 14A and 14B on the base unit 2, the manifolds 14A and 14B fail to be connected directly to the driver board 4. Therefore, even when an error arises in the size of the driver board 4, any trouble is not likely in the operation of mounting the manifolds 14A and 14B.

Figure 6:
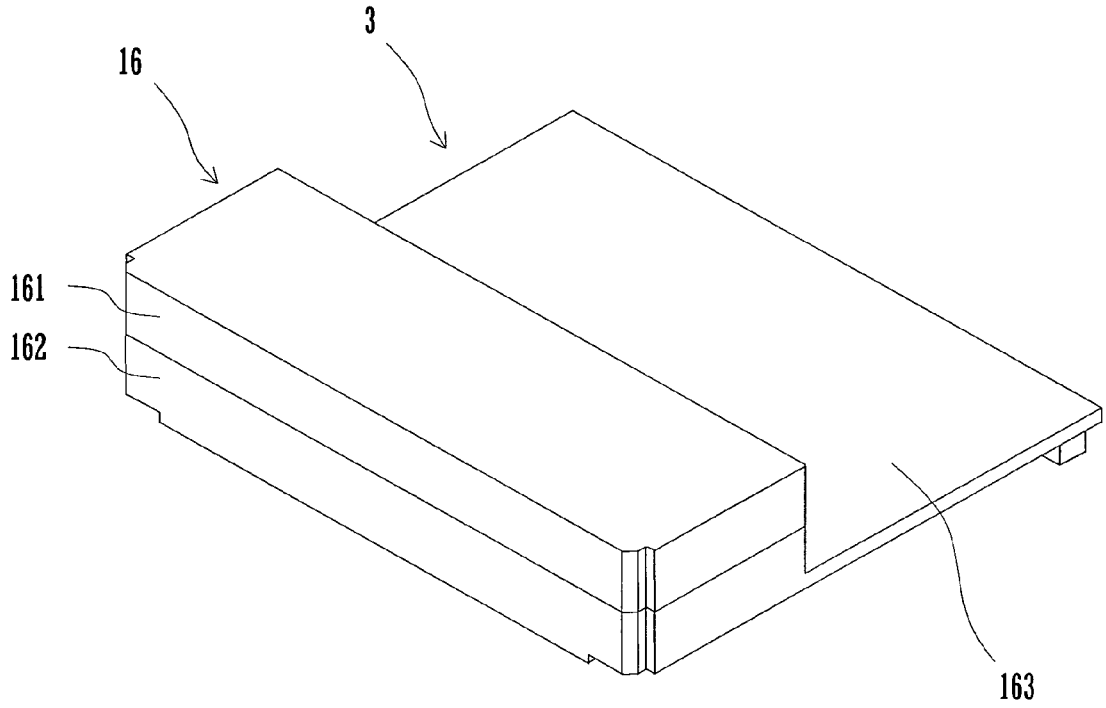
FIG. 6 is a perspective view showing the configuration of a filter unit.

The configuration of the filter unit 3 will be described with reference to FIG. 6. The filter unit 3 forms a third flow path forming member defined by the present invention. The filter unit 3 includes two housings 161 and 162 each formed from PEEK (polyether ether ketone). A filter plate for filtering liquid is disposed so as to separate liquid chambers formed inside the respective housings 161 and 162 from each other. The liquid chamber of the housing 161 is formed with an introduction port for introducing liquid from a non-illustrated liquid storage section. Within the liquid chamber of the housing 162, there is formed a flow path to communicate with the first opening 57A of the manifold 14A. Further, the housing 162 is formed with a non-illustrated vent flow path to communicate with the first opening 56A of the manifold 14B. The vent flow path is connected to the liquid storage section through a vent flow path formed in the housing 161.

Figure 7:
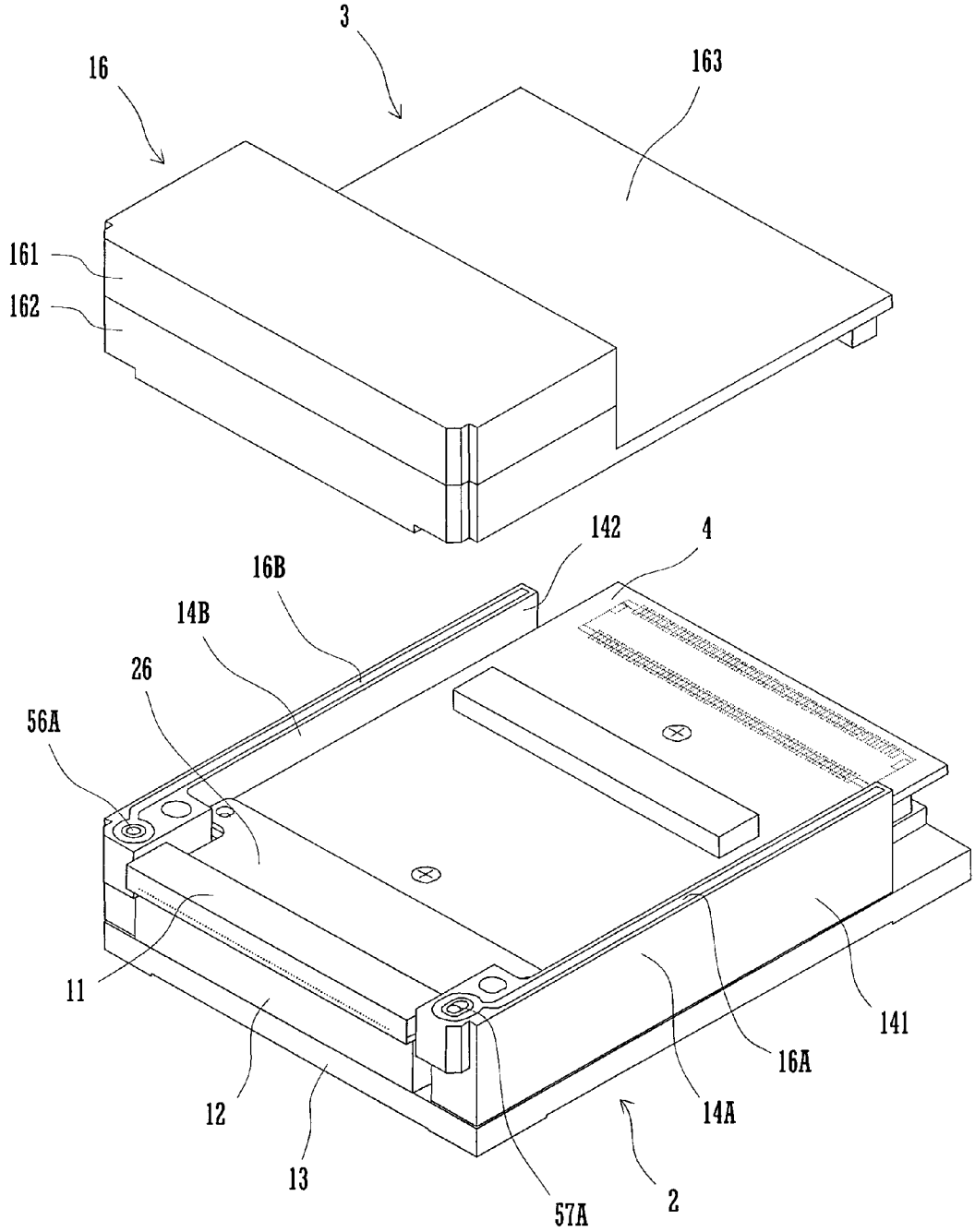
FIG. 7 is an exploded view showing the base unit and the filter unit in a disassembled state.
Figure 8:
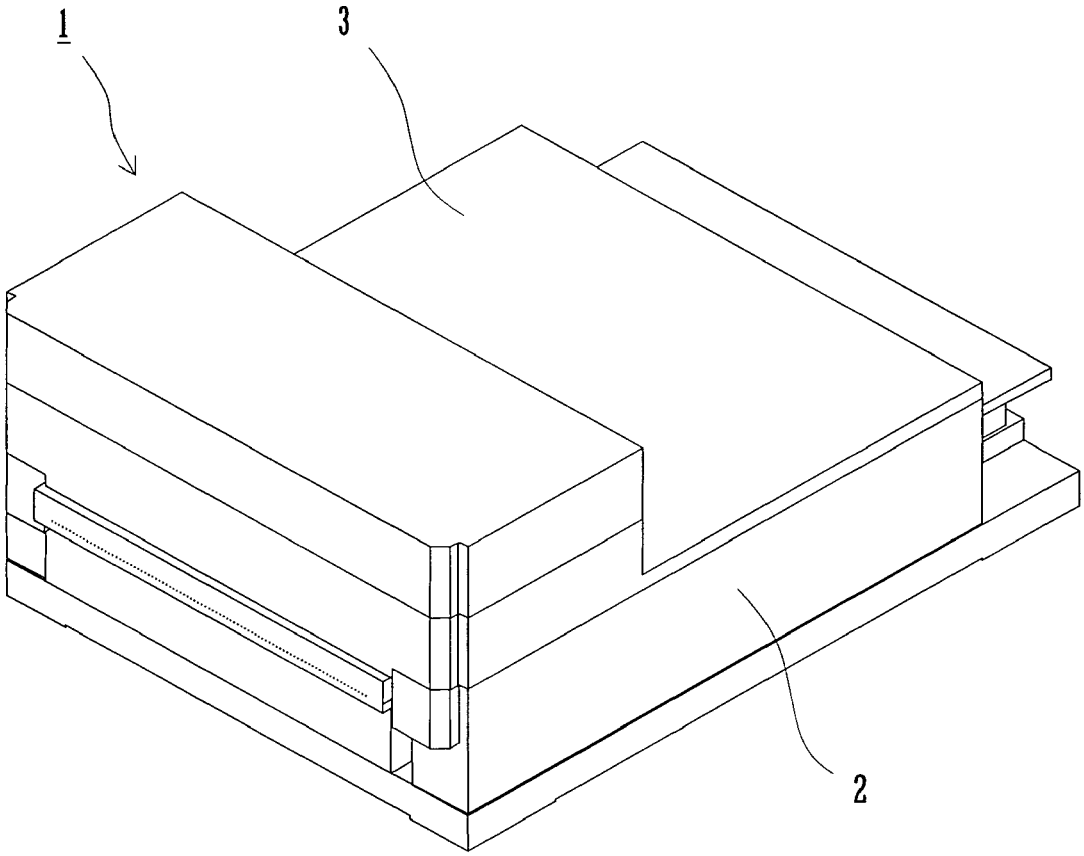
FIG. 8 is a view showing the base unit and the filter unit in an assembled state.

As shown in FIG. 7, the manifolds 14A and 14B are formed with grooves 16A and 16B, respectively. The grooves 16A and 16B are filled with adhesive when the manifolds 14A and 14B and the filter unit 6 are to be attached to each other. The adhesive used in the grooves 16A and 16B preferably has a linear expansion coefficient close to that of the material of the manifold 14A and 14B and filter unit 6. In the present embodiment, the grooves 16A and 16B are filled with an epoxy adhesive. FIG. 8 shows a state in which the filter unit 6 and the manifolds 14A and 14B are bonded together by means of the adhesive. By employing such a technique of attaching the manifolds 14A and 14B to the head chip 11 from the opposite sides, the flow path assemblage becomes easy. As compared with flow path formation by a single member, the structures of the respective manifolds 14A and 14B can be simplified, which makes it possible to reduce the cost of flow path formation. Further, since the filter unit 6 is disposed near the head chip 11, the ink-jet head 1 can be rendered compact.

Figure 9:
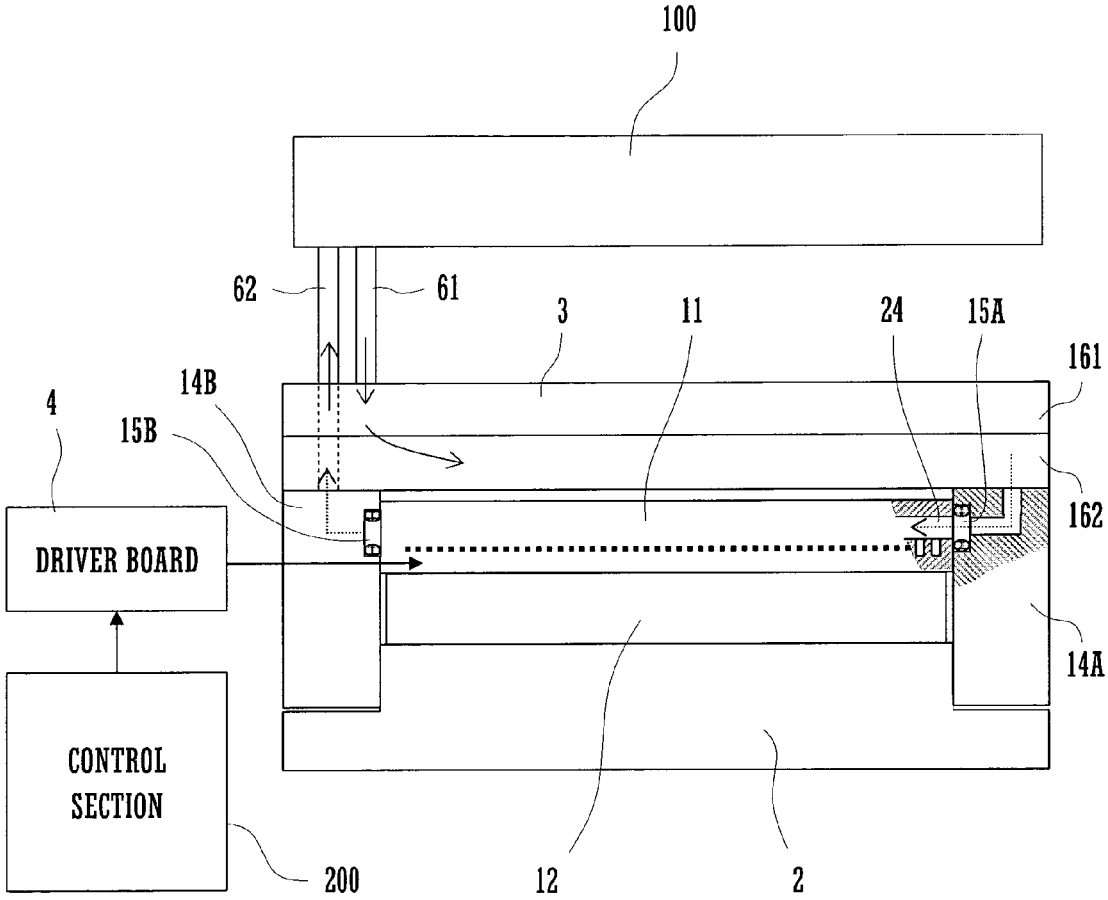
FIG. 9 is a view schematically showing the configuration of the ink-jet head.

FIG. 9 is a view schematically showing the configuration of the ink-jet head 1. In the hatched portion shown in FIG. 9, a part of the liquid flow path is shown in section. As already described, the chip mount 12 has a smaller width than the head chip 11 and the mount 131 of the head base 13. Therefore, gaps are respectively defined between the chip mount 12 and the manifold 14A and between the chip mount 12 and the manifold 14B. For this reason, even when the amount of the adhesive used to bond the head chip 11 to the chip mount 12 or the amount of the adhesive used to bond the chip mount 12 to the head base 13 is excessive, the excess of the adhesive can be absorbed by the aforementioned gaps. As a result, the adhesive fails to flow in between the head chip 11 and the manifolds 14A and 14B and between the head base 13 and the manifolds 14A and 14B.

In the present embodiment, the head chip 11 and the manifolds 14A and 14B are not fixed directly to each other. For this reason, even when a change in temperature gives rise to a difference in amount of deformation between the head chip 11 and the manifolds 14A and 14B due to the difference in linear expansion coefficient therebetween, such a difference in amount of deformation can be absorbed by the elastic seal members 15A and 15B. As a result, the head chip 11 and the manifolds 14A and 14B are not susceptible to thermal stress.

Since the first and second elastic seal members are disposed on opposite sides of the droplet jet unit, the first and second elastic seal members exert their respective forces on the droplet jet unit so as to cancel each other. As a result, even when a frictional force is produced between the head chip 11 and the chip mount 12 by repulsion forces of the elastic seal members 15A and 15B working on the head chip 11, such a frictional force can be minimized.

In the construction described above, the liquid is supplied from the liquid storage section 100 into the housing 161 through a tube 61 during an initial liquid charging stage. The liquid thus supplied into the housing 161 is filtered by passing through the filter plate before introduction into the housing 162. The liquid is then guided from the housing 162 to the common liquid chamber of the head chip 11 through the manifold 14A. Further, the liquid having passed through the common liquid chamber returns to the liquid storage section 100 by passing through the flow path defined within the manifold 14B, vent flow paths formed in the housings 161 and 162, and a tube 62. As the liquid circulates, residual air present within the common liquid chamber is removed. When the removal of residual air is completed, the return path intermediate the manifold 14B and the liquid storage section 100 is shut off by means of a non-illustrated valve. Thereafter, a control section 200 controls the driver board 4 so as to drive the driving electrodes in the respective individual liquid chambers of the head chip 11. Thus, the head chip 11 jets the liquid.

As described above, the ink-jet head 1 according to the present embodiment has a merit that residual air present within the common liquid chamber can be discharged efficiently by circulating the liquid through the liquid storage section 100, filter unit 3 and head chip 11. Further, since the head chip 11 is provided with the liquid introduction port 23A and liquid discharge port 23B, the liquid circulating path can be formed easily.

Further, the use of PEEK for the manifolds 14A and 14B and the filter unit 3 improves the liquid resistance of the flow path forming unit. When an epoxy adhesive is used to bond members formed from PEEK to each other, it is possible to prevent the occurrence of crack due to the difference in thermal expansion coefficient as well as to ensure a satisfactory bond strength. Therefore, the use of such an epoxy adhesive makes the ink-jet head 1 more resistant to temperature changes.

Instead of the arrangement for circulating the liquid through the liquid introduction port 23A and liquid discharge port 23B, it is possible to employ an arrangement wherein in the initial stage of charging the liquid into the head chip 11, the liquid is introduced from the liquid introduction port 23A side and then discharged through a non-illustrated drain in communication with the liquid discharge port 23B. In this case, the drain in communication with the liquid discharge port 23B is simply shut off after the removal of residual air. Such an arrangement makes it possible to efficiently discharge residual air together with discharged liquid. In addition, this arrangement further simplifies the flow path, thereby making it possible to reduce the manufacturing cost.

Referring again to FIG. 7, description will be made of another merit of the ink-jet head 1 according to the present embodiment. As shown, the driver board 4 and flexible board 26 on the head base 13 are covered with the manifolds 14A and 14B and filter unit 3. Specifically, the driver board 4 is protected by being substantially entirely covered with a plate portion 163 extending from the housings 161 and 162, a plate portion 141 extending from the flow path forming portion of the manifold 14A, and a plate portion 142 extending from the flow path forming portion of the manifold 14B. For this reason, the driver board 3 is prevented from damage due to liquid splashed thereon. Further, the driver board 4 is protected with such indispensable members as the manifolds 14A and 14B and the filter unit 3 and, hence, there is no need to provide a separate member for merely protecting the driver board 4. Thus, the number of constituents can be reduced.

As also shown in FIG. 7, the manifolds 14A and 14B located on the opposite sides of the head chip 11 are coupled to each other by the filter unit 3, to form a gate-shaped structure as a whole. With such a structure, the flow path forming portions have an increased rigidity. For this reason, the flow path is not prone to damage even when the repulsion forces by the elastic seal members 15A and 15B or an external force from the outside is exerted thereon.

It is sufficient that those parts of the driver board 4 which should be protected are covered with the plate portions 163, 141 and 142 and, hence, the driver board 4 need not necessarily be entirely covered with the plate portions 163, 141 and 142. The main function of the plate portions 163, 141 and 142 is to protect electrical connections with those parts which have a high possibility of damage when splashed with liquid and cannot but be located near the flow path (for example, electronic components such as a driver IC, capacitor, and diode), as well as a wiring portion interconnecting the head chip 11 and the driver board 4. There is no need to protect those parts which can be located away from the flow path, such as a connector for interconnecting the driver board 4 and an external driving circuit, by the plate portions 163, 141 and 142. Such parts may otherwise be protected using a sealing material for example.

The foregoing embodiment is illustrative in all points and should not be construed to limit the present invention. The scope of the present invention is defined not by the foregoing embodiment but by the following claims. Further, the scope of the present invention is intended to include all modifications within the meanings and scopes of claims and equivalents.

The invention claimed is:

1. A droplet jet unit for jetting supplied liquid through plural nozzles, comprising:

a main body;

a common liquid chamber located inside the main body;

plural individual liquid chambers located inside the main body and communicating with the common liquid chamber and with respective of the plural nozzles;

a liquid introduction port which is continuous with the common liquid chamber and exposed at a first lateral side of the main body; and a liquid discharge port which is continuous with the common liquid chamber and exposed at a second lateral side of the main body which is opposite away from the first lateral side.

2. A droplet jet device including the droplet jet unit according to claim 1 for jetting droplets by using the droplet jet unit, the droplet jet device comprising:

a first elastic seal member provided at the liquid introduction port;

a second elastic seal member provided at the liquid discharge port; and a flow path forming unit having at least a first flow path forming portion defining therein a first liquid flow path to become continuous with the liquid introduction port, and a second flow path forming portion defining therein a second liquid flow path to become continuous with the liquid discharge port, the flow path forming unit being disposed in such a manner that the first flow path forming portion is pressed against the first lateral side through the first elastic seal member while the second flow path forming portion pressed against the second lateral side through the second elastic seal member.

3. The droplet jet device according to claim 2, further comprising:

a base member on which the droplet jet unit and the first and second flow path forming portions are mounted; and an intervening member formed from a hard ceramic and intervening between the droplet jet unit and the base member by being fixed to a side of the droplet jet unit other than the first and second lateral sides and to the base member.

4. The droplet jet device according to claim 3, wherein the intervening member is disposed to define a gap with the first flow path forming portion and a gap with the second flow path forming portion.

5. The droplet jet device according to claim 4, wherein the flow path forming unit includes a third flow path forming portion which defines therein a third liquid flow path to be connected to the first and second liquid flow paths and is disposed so as to cover the base member cooperatively with the first and second flow path forming portions.

6. The droplet jet device according to claim 5, wherein the third flow path forming portion serves also as a filter unit for filtering the liquid.

7. The droplet jet device according to claim 6, wherein the first, second and third flow path forming portions are formed from PEEK (polyether ether ketone), while the third flow path forming portion is bonded to the first flow path forming portion and to the second flow path forming portion with an epoxy adhesive.

8. A droplet jet device for jetting liquid supplied from a liquid storage section, comprising:

a droplet jet unit configured to jet the liquid through plural nozzles;

a driving circuit configured to drive the droplet jet unit;

a connecting section interconnecting the droplet jet unit and the driving circuit;

a base member carrying the droplet jet unit and the driving circuit thereon; and a flow path forming unit connected to the liquid storage section and to the droplet jet unit and defining therein a liquid flow path to be connected to the liquid storage section and to the droplet jet unit, wherein the flow path forming unit being disposed so as to cover the connecting section and the driving circuit;

wherein the flow path forming unit is mounted on the base member; and wherein the droplet jet unit includes a main body having a rectangular parallelepiped shape, a liquid introduction port exposed at a first lateral side of the main body, and a liquid discharge port exposed at a second lateral side of the main body which is opposite away from the first lateral side; and the flow path forming unit is shaped like a gate in a sectional view and disposed so as to sandwich the droplet jet unit from the first and second lateral sides.

* * * * *